United States Patent [19]

Kaanders et al.

[11] 4,440,982

[45] Apr. 3, 1984

[54] HEARING AID

[75] Inventors: Johannes M. G. M. Kaanders; Cornelis H. M. van Rijsewijk; Antoon F. Smerecnik, all of Eindhoven, Netherlands

[73] Assignee: U.S. Philips Corporation, New York, N.Y.

[21] Appl. No.: 346,669

[22] Filed: Feb. 8, 1982

[30] Foreign Application Priority Data

Mar. 17, 1981 [NL] Netherlands ..... 8101286

[51] Int. Cl.[3] ..... H04R 1/28; H04R 25/00

[52] U.S. Cl. ..... 179/107 R; 179/146 R

[58] Field of Search ..... 179/1 FS, 107 R, 107 FD, 179/180, 107 S; 181/22, 129, 137

[56] References Cited

U.S. PATENT DOCUMENTS 2,894,076 7/1959 Posen ..... 179/107 S 3,019,306 1/1962 Weiss ..... 179/146 R 3,534,183 10/1970 Knowles ..... 179/180

3,812,300 5/1974 Brander et al. ..... 179/107 R

*Primary Examiner*—G. Z. Rubinson

*Assistant Examiner*—Danita R. Byrd

*Attorney, Agent, or Firm*—Robert T. Mayer; Bernard Franzblau

[57] ABSTRACT

A hearing aid includes a duct (10) for transmitting the sound from the receiver (2) to the exterior of the housing (1) of the hearing aid. The duct is formed in a component (9) which is constituted by a body of an elastic damping material and which also serves as the sole suspension means for the receiver (2). The suspension means supports the receiver mainly on that side of the receiver where the sound outlet (12) of the receiver is located. This minimizes the mechanical-acoustic coupling between the receiver and the microphone (3) of the hearing aid.

6 Claims, 2 Drawing Figures

HEARING AID

BACKGROUND OF THE INVENTION

This invention relates to a hearing aid having a microphone and a receiver which comprises a sound outlet connected to a sound-transmission duct, the receiver being positioned in a housing of the hearing-aid by suspension means. Such a hearing aid is known from German Gebrauchsmuster No. 77.07.822.

In known hearing aids the sound-transmission duct generally comprises a thin walled tube of an elastic material. The sound waves produced by the receiver issue from the hearing aid via said tube and are transmitted to an ear of the person wearing the hearing aid.

The receiver is positioned in the hearing aid by suspension means. For this purpose the receiver is in mechanical contact with the hearing-aid housing at locations which are proportionally distributed over the receiver wall area via an intermediate element of an elastic material generally in the form of a projection or a sphere.

In known hearing aids, especially at high gain factors, a feedback effect may arise so that the hearing aid no longer functions correctly.

It is an object of the invention to mitigate said feedback in hearing aids in a simple yet effective manner.

SUMMARY OF THE INVENTION

According to the invention there is provided a hearing aid having a microphone and a receiver which comprises a sound outlet connected to a sound-transmission duct. The receiver is positioned in a housing of the hearing aid by suspension means, wherein the sound-transmission duct is formed in a component which is constituted by a body of an elastic damping material and which is constructed to serve also as the sole suspension means for the receiver. This suspension means acts wholly or mainly on that side of the receiver where the sound outlet of the receiver is located.

The invention resulted from investigations which revealed that the feedback effect is mainly caused by a mechanical-acoustic coupling between the receiver and microphone. The sound waves produced in the receiver give rise to reaction forces which cause the receiver wall to vibrate. These mechanical vibrations are transmitted to the hearing aid housing mainly via the known receiver suspension means. The vibrations of the hearing aid housing in turn give rise to acoustic or sound waves, which may reach the microphone both via an external path and via the interior of the hearing aid and which are then detected by the microphone and are again amplified and reproduced by the receiver, thereby closing the feedback loop. This results in an irregularity in the frequency response of the hearing aid at frequencies around 500 Hz. Experiments have revealed that the mechanical-acoustic transmission path should be interrupted nearest the source (i.e. the receiver) in order to obtain a most effective interruption of said feedback loop. Hence, it is necessary only to reduce the mechanical coupling between the receiver and the hearing aid housing.

In a hearing aid in accordance with the invention the sound-transmission duct is formed in a component which is constituted by a body made of an elastic damping material and which in effect forms a thick-walled duct. This component is constructed so as to function as the sole suspension means for the receiver and supports the receiver mainly on that side of the receiver where the sound outlet is located. On this side the mechanical vibrations of the receiver wall appeared to have the lowest amplitude, so that the suspension means provide a particularly effective decoupling of the receiver relative to the housing. Moreover, since the component is constituted by a body of an elastic damping material, the transmission of mechanical vibrations of the receiver to the hearing aid housing is further reduced. This is because the vibrations in the body are damped and absorbed additionally. Moreover, the invention has advantages with respect to design and production engineering. In comparison with known hearing aids, where the sound-transmission duct and the suspension means are constituted by two separate components, the sound-transmission duct and the suspension means in the hearing aid in accordance with the invention are obtained by means of a single component, which simplifies and speeds-up and thus reduces the cost of the production process. It is to be noted that the published German Patent Application No. 1,160,010 describes a hearing aid in which a component which constitutes the sound-transmission duct also engages with that side of the receiver where the sound outlet of the receiver is located. However, this component does not serve for positioning the receiver. The receiver in this known hearing aid is freely movable in the housing and is provided with damping blocks over its entire outer surface to prevent the receiver from striking the inner side of the hearing aid housing when the hearing aid is subjected to shocks.

In a preferred embodiment of the hearing aid in accordance with the invention the component, over at least a part of its outer surface, fits loosely against the inner side of the hearing aid housing. This preferred embodiment ensures that the receiver is correctly positioned in all directions. By arranging the suspension means loosely against the inner side of the housing, the damping properties of the suspension means are utilized to an optimum extent, so that the mechanical coupling between the receiver and the housing can be minimized.

In another embodiment of the hearing aid in accordance with the invention the component comprises a wall portion which encloses the receiver and which is thin in comparison with that part of the component which incorporates the sound transmission duct. This may result in an improved attachment of the receiver to (or in) said component.

BRIEF DESCRIPTION OF THE DRAWINGS

Two embodiments of the invention will now be described in more detail with reference to the accompanying drawings, in which.

DETAILED DESCRIPTION OF THE PREFERRED EMBODIMENT

Figure 1:
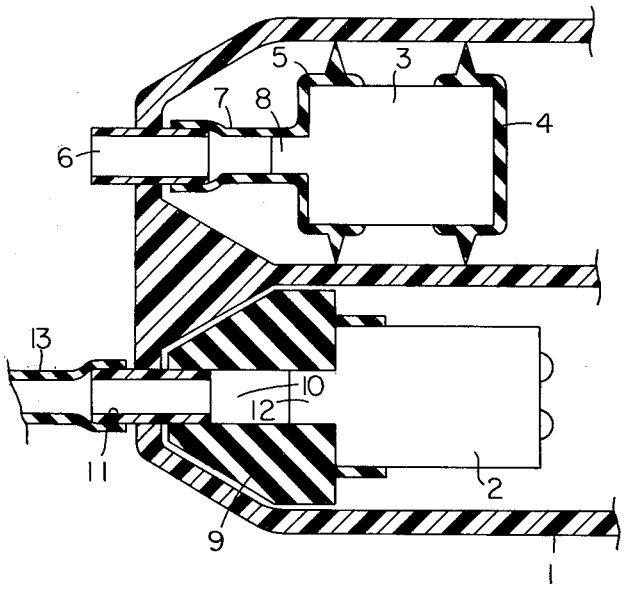
FIG. 1 is a sectional view of a first embodiment.

The hearing aid shown in FIG. 1 comprises a housing 1 which accommodates a receiver 2 and a microphone 3. The microphone 3 is positioned in the housing 1 of the hearing aid by suspension means 4 and 5 which are known per se. Via a tube 7 the sound inlet 6 of the hearing aid is acoustically connected to the sound inlet 8 of the microphone. The tube 7 and the part 5 of the suspension means form an integral part, though this is not essential. Since the invention does not relate to the microphone and/or its suspension the exact construction of these parts of the hearing aid is irrelevant and will not be described in more detail.

The receiver 2 is connected to a component 9 by clamping or gluing or by some other convenient method. The component 9 is formed with a duct 10 and is connected to the housing 1 by means of a rigid tube 11 only. The component 9 has an external shape such that it fits loosely within the inner side of the housing 1 of the hearing aid. For this purpose the external dimensions of the component 9 are made just slightly smaller than the internal dimensions of the housing 1 at the location where the component 9 is positioned in the housing 1. It is to be noted that it is not necessary for the component 9 to fit against the inner side of the housing 1 over substantially its entire outer surface, as is shown in FIG. 1. It is alternatively possible for the component 9 to fit against the inner side of the housing 1 over only a part of its outer surface. The receiver 2 is secured to the component 9 only, and has no mechanical contact with the housing 1 other than via the component 9. The component 9 consequently functions as the sole suspension means for the receiver 2, which suspension means supports the receiver mainly on that side of the receiver where the sound outlet 12 is located, and positions the receiver 2 correctly in the hearing aid housing. Preferably, the component 9 is formed by a body of an elastic damping material, for example rubber. The sound outlet 12 of the receiver 2 terminates in one end of the duct 10. This duct serves for transmitting the sound waves. The other end of the duct 10 adjoins the tube 11, which projects from the exterior of the hearing aid housing. On the portion of the tube 11 which projects from the hearing aid housing an acoustic tube 13 is fitted. This acoustic tube transmits the sound from the hearing aid to the ear of the person wearing the hearing aid. The tube 11 is rigidly connected to the housing 1. It can be seen that the component 9 serves not only as the receiver suspension means but also transmits the sound from the receiver out of the hearing aid.

Figure 2:
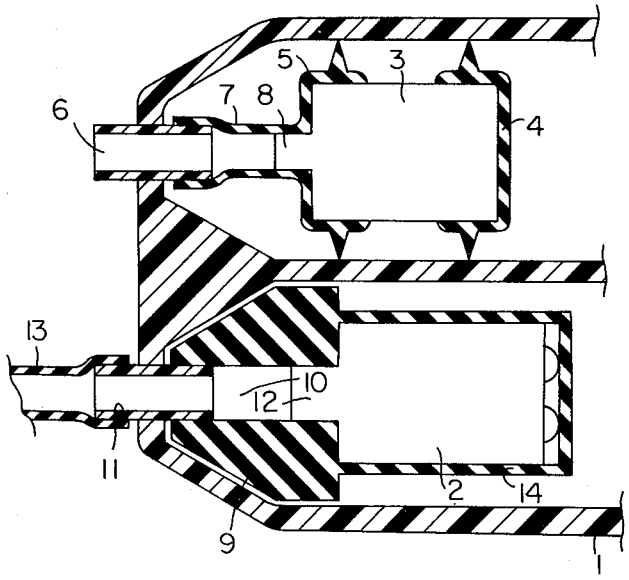
FIG. 2 is a sectional view of a second embodiment of the hearing aid in accordance with the invention.

The embodiment shown in FIG. 2 largely corresponds to that of FIG. 1 and identical components in FIGS. 1 and 2 bear the same reference numerals. In the embodiment of FIG. 2, however, the component 9 has a thin-walled portion 14 which encloses the receiver 2.

It is to be noted that the invention is applicable not only to the hearing aids shown in the drawings but may also be applied to hearing aids which differ from the embodiments shown with respect to points which are irrelevant to the invention.

What is claimed is:

1. A hearing aid comprising, a housing having an outlet opening therein, a microphone supported within the housing, a receiver having a sound outlet for connection to a sound transmission duct, suspension means for supporting the receiver within said housing, said suspension means comprising a component including a body located within the housing and made of an elastic damping material and having a sound transmission duct within said body which communicates with the sound outlet in the receiver, said suspension means further comprising a rigid duct supported in said outlet opening of the housing and coupled to said body so that the rigid duct communicates with the sound duct within said body and also functions as the sole support for said component and said receiver such that the component is only in physical contact with the housing at the inner surface of said outlet opening and via said rigid duct located therein, said suspension means supporting the receiver mainly on the side of the receiver where the receiver sound outlet is located whereby sound vibrations produced in the walls of the receiver are substantially damped from reaching the housing.

2. A hearing aid as claimed in claim 1 wherein said component fits loosely within the housing so as to provide a small gap between the outer surface of the component and an inner surface of the housing.

3. A hearing aid as claimed in claim 1 wherein the receiver sound outlet, the sound transmission duct within the body and the rigid support duct are in linear alignment to provide a linear sound transmission path between the receiver sound outlet and the outlet opening of the housing.

4. A hearing aid as claimed in claim 3 wherein the microphone includes a sound inlet, and a further sound transmission duct arranged parallel to the sound duct within the body and coupling the microphone sound inlet to an inlet opening located in the same wall of the housing as the housing outlet opening.

5. A hearing aid comprising, a housing having an outlet opening, a microphone supported within the housing, a receiver having a sound outlet coupled to a sound-transmission duct, the receiver being positioned in said housing by suspension means, wherein the sound-transmission duct is formed in a component constituted by a body made of an elastic damping material and constructed so as to function as the sole suspension means for the receiver, the suspension means supporting the receiver mainly on that side of the receiver where the receiver sound outlet is located such that the component fits loosely within the housing and adjacent the inner side of the housing over at least a part of the outer surface of the component.

6. A hearing aid as claimed in claim 5 wherein the component includes a wall portion which encloses the receiver and which is thin in comparison with that part of the component which incorporates the sound transmission duct.

* * * * *